United States Patent [19]

BonDurant

[11] 4,377,052

[45] Mar. 22, 1983

[54] FOLDED PAPER AIRPLANE

[76] Inventor: James M. BonDurant, Box 99, Bowersville, Ohio 45307

[21] Appl. No.: 307,327

[22] Filed: Sep. 30, 1981

[51] Int. Cl.[3] ..... A63H 27/00

[52] U.S. Cl. ..... 46/79

[58] Field of Search ..... 46/79, 81, 1 L

[56] References Cited

U.S. PATENT DOCUMENTS

| | | | |
|---|---|---|---|
| 1,089,713 | 3/1914 | Liljencrantz | 46/79 UX |
| 1,420,805 | 6/1922 | Baehr | 46/79 UX |
| 2,154,487 | 4/1939 | Bonnell | 46/79 UX |
| 2,529,979 | 11/1950 | Turnbull | 46/79 UX |
| 2,825,179 | 3/1958 | Ferlen | 46/79 UX |
| 3,010,250 | 11/1961 | Huston | 46/79 UX |
| 3,540,149 | 7/1970 | Lowe | 46/79 |
| 4,172,337 | 10/1979 | English | 46/79 UX |
| 4,292,757 | 10/1981 | Cahen | 46/81 X |

*Primary Examiner*—F. Barry Shay
*Attorney, Agent, or Firm*—Harvey B. Jacobson

[57] ABSTRACT

A folded paper airplane formed of a blank of sheet material having a downfold line extending along an axis of the sheet, a pair of transverse cuts near a rear edge and forming a tail piece, a pair of fuselage forming upfold lines extending from the midpoints of segments of the forward edge to a point adjacent the intersection of the downfold line and the transverse cuts, a pair of cockpit forming downfold lines extending from the midpoints, a pair of set of at least two successive upfold lines extending from the same midpoints, and a pair of wing forming downfold lines extending from the leading edges of the resulting wing surfaces near the cockpit to terminate at the other distal ends of the transverse cuts.

10 Claims, 10 Drawing Figures

Fig. 1
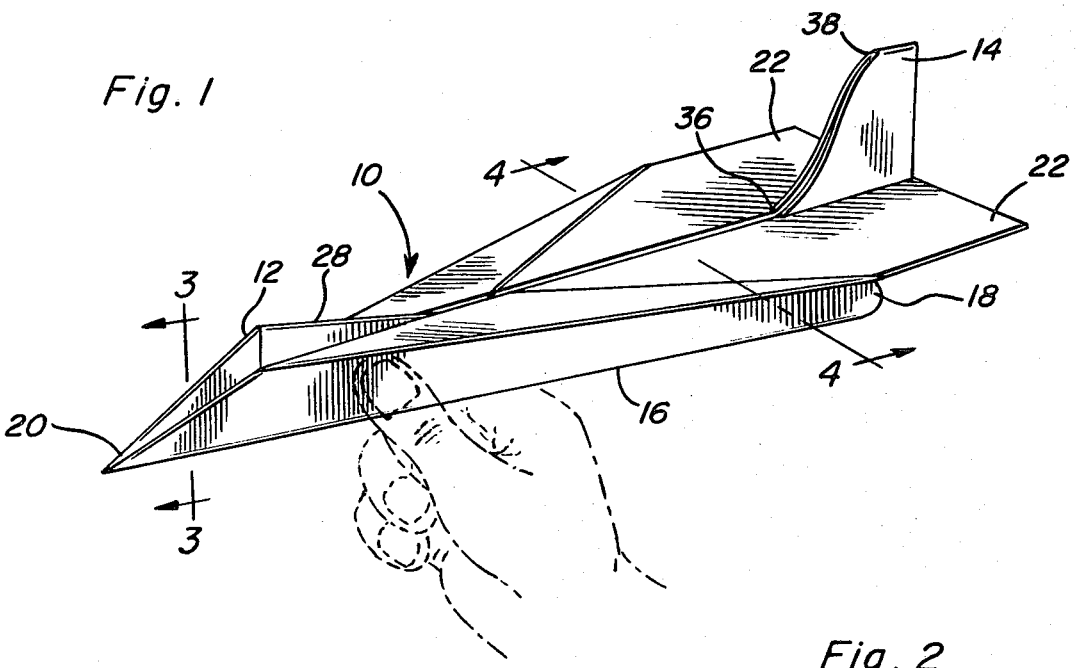
Fig. 2
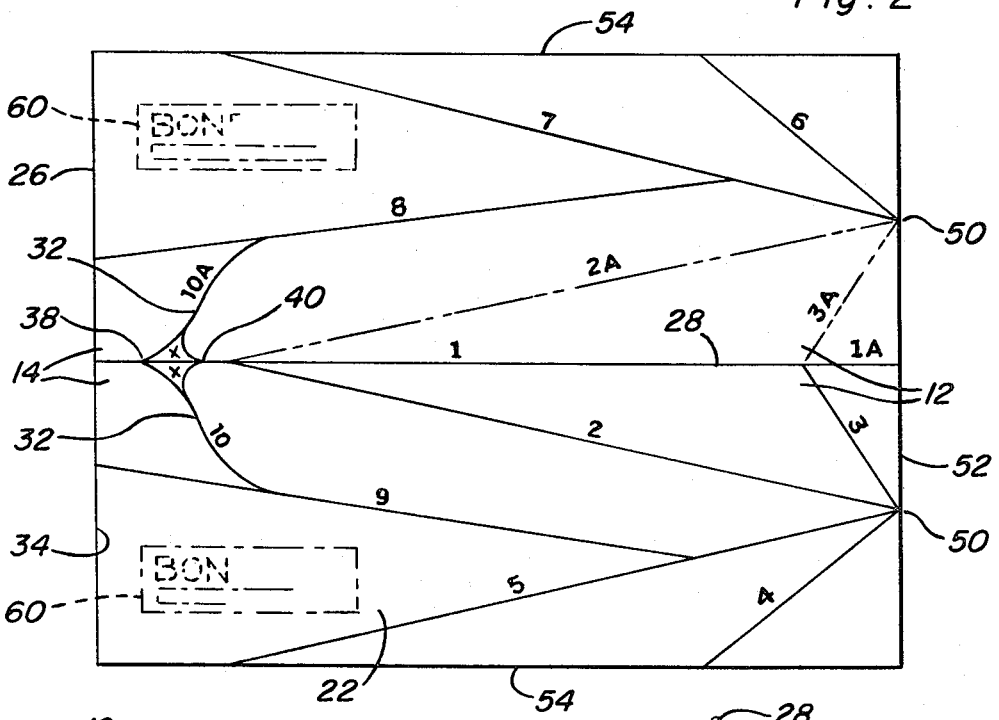
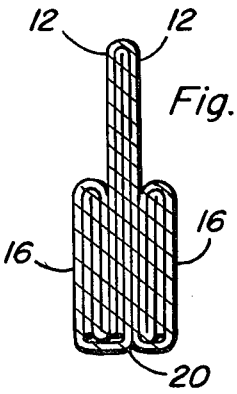
Fig. 3
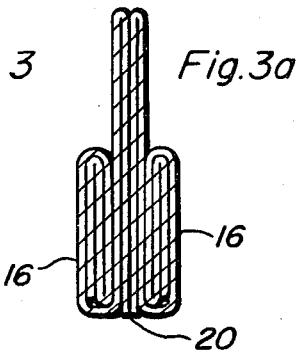
Fig. 3a
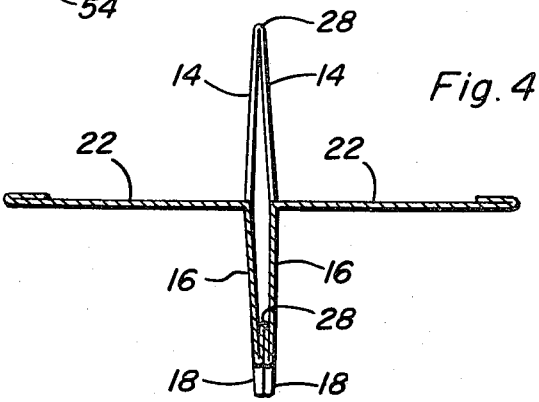
Fig. 4

FOLDED PAPER AIRPLANE

BACKGROUND OF THE INVENTION

The present invention relates to a new and improved folded paper airplane constructed of a single folded paper blank having a minimum of cuts forming contoured surfaces of the airplane, and more particularly the invention is directed to a simple and easily constructed folded paper airplane that is attractive to the user and simple of construction as well as having a resemblance to modern supersonic aircraft.

1. Field of the Invention

The novel and folded paper airplane of the invention not only has a cockpit but it has a discernable mode of flight that can be easily regulated by changing a shape or contour of the wing structure, the tail section, or even of the fuselage and cockpit section of the airplane. Further it is clearly within the purview of the present invention to provide printed instructions in detail for folding and constructing the completed folded paper airplane and as well as to provide informational material, cognitive indicia, advertising data and the like. Thus, it is seen that a convenient and easily constructed paper airplane can be used for promotional material, instructional material, and for other general informational purposes connected with instruction of children, others and the like.

2. Description of the Prior Art

The prior art shows at least, many and various forms of paper airplanes folded from blanks and other lightweight materials with the following patents being representative thereof:

U.S. Pat. No. 1,420,805—A. D. Baehr—June 27, 1922
U.S. Pat. No. 2,154,487—E. Bonnell—Apr. 18, 1939
U.S. Pat. No. 2,529,979—R. B. Turnbull—Nov. 14, 1950
U.S. Pat. No. 2,825,179—R. P. Ferlen—Mar. 4, 1958
U.S. Pat. No. 3,010,250—C. E. Huston, Jr. —Nov. 28, 1961
U.S. Pat. No. 3,540,149—L. G. Lowe—Nov. 17, 1970
U.S. Pat. No. 4,172,337—R. L. English—Oct. 30, 1979

The Huston and English patents disclose arrangments having a stabilizer formed by transversely extending cut lines which enable a portion of the sheet of paper to be folded upwardly forming an inverted V-shaped stabilizer. Thus, none of these above and several patents, whether taken and viewed singly or in combination with each other, are believed to have a bearing on the patentability of any claim of the invention.

SUMMARY OF THE INVENTION

An object and advantage of the present invention to provide a folded paper airplane made completely from a single sheet of material formed as a blank without necessity of gluing or using separate parts and with a minimum of transverse cut or other cut segments disposed in its construction.

More particularly, an object and advantage of the present invention is to provide a folded paper airplane resembling in some respects a supersonic airplane which has useful flight characteristics as well as being somewhat adjustable in its flight characteristics by adjusting wings, fuselage, or other components as folded for forming the resulting airplane.

Another object, feature and advantage of the present invention to provide a device which is eaily manufactured in the form of pre-identified fold lines and which may be provided with informational material, advertising material and other promotional material printed thereon together with instructions and the like.

Another and additional feature of the invention is to construct an airplane from a single blank, whether scored for folding and creasing or merely printed for folding pursuant to any given instructions and which may form an airplane without using glue, paste and other construction products or additional sheets or blanks of sheet material.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a front perspective view of a folded paper airplane according to a best mode and preferred embodiment of the invention.

FIG. 2 is a plan view of a blank of sheet material having printed or scored thereon information concerning folds, cuts and the like for forming the folded paper airplane according to the invention.

FIG. 3 is a sectional view taken along line 3—3 of FIG. 1.

FIG. 3A is a sectional view similar to FIG. 3 but in which the folds comprise a modification of that embodiment.

FIG. 4 is a sectional view taken along line 4—4 of FIG. 1.

DETAILED DESCRIPTION OF THE PREFERRED EMBODIMENT

Figure 5:
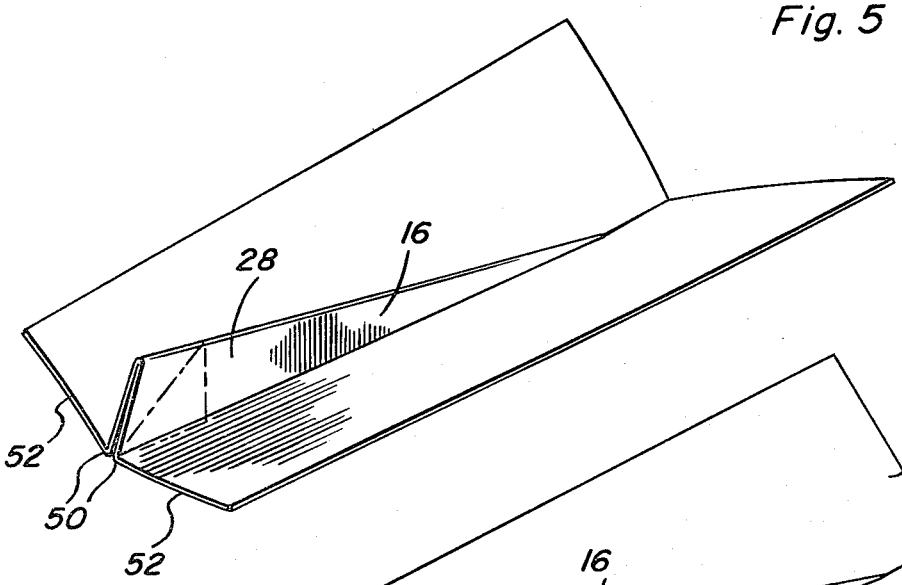
FIGS. 5–9 are perspective views showing the steps in forming the blank of FIG. 2 into the airplane of FIG. 1.

Referring now to the drawings there is shown a folded paper airplane 10 being held by one's right hand and in which there is cockpit area 12, a tail piece 14, fuselage section 16 having a rounded rear section 18 together with a pointed nose or forward section 20, and wings 22 all of which resemble in contour a supersonic jet passenger airplane or the like. The folded paper airplane 10 is shown constructed of a blank 26 of sheet material having a downfold line 28 extending centrally or axially along the sheet material and having a pair of transverse cuts 32, 32 near a rear edge 34 of the blank, the transverse cuts forming a modified S-shaped configuration in which one end of the cut is at the downfold line 28 and the other terminating or extending to a point where the tail piece 14 is to conjoin with the fuselage 16 and wing 22. This point is shown as 36 while the other end of the S-shaped cut is point 38 and the cut 32, 32 is shown to contour the rear section 18 of the fusalage at point 40 as shown in FIG. 2. Also shown in FIG. 2 are printed indicia on the blank 26 and constitute instructional identification of various fold lines, 1A, 2, 2A, 3, 3A, 4, 5, 6, 7, 8, 9, 10, and 10A, together with cutout segments X,X.

FIG. 3 shows the section of the folded paper airplane taken forwardly of the cockpit area 12 and the composite folding of the blank forming the forward end of the fuselage 16 coming to the point 20, the forward point of the entire fuselage. Line 1A is downfold in FIG. 3 being folded over the upfold 3A, while in FIG. 3A, line 1A is an upfold and lines 3, 3A are downfolds showing line 1A as an infold line.

FIG. 4 shows the tail section 14 formed about the fold 28 and in which the fuselage terminates about portion 18 encompassing also a fold 28 forming the posterior of the fuselage and being encompasses within the fuselage structure 16, 16.

Figure 6:
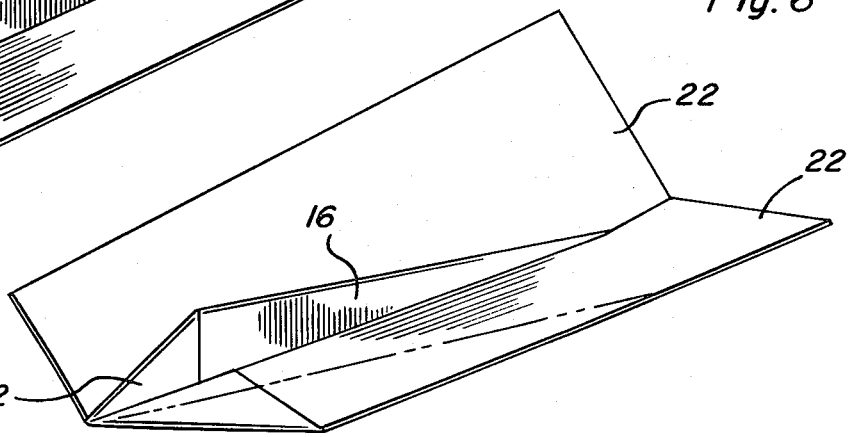
Figure 7:
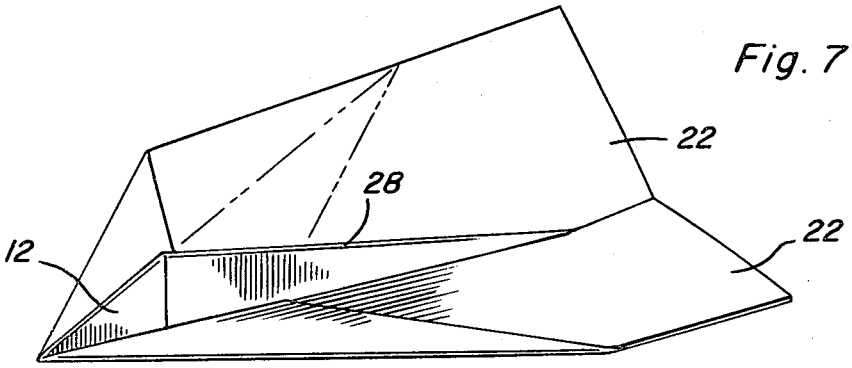
Figure 9:
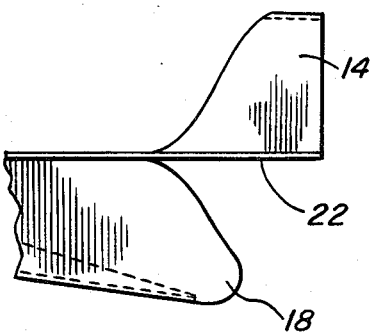
Figure 8:
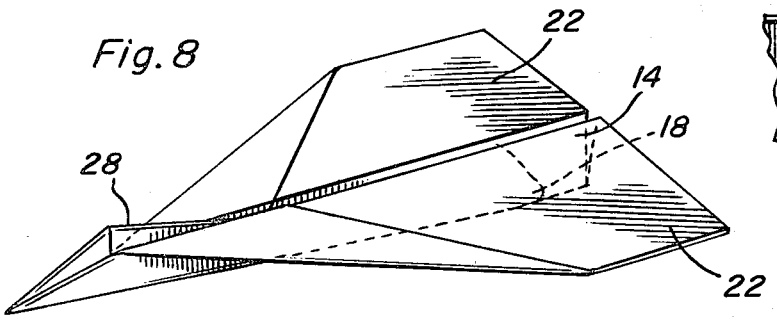

FIG. 5 shows an initial stage of forming the folded paper airplane wherein is the base or initial downfold 28 forming interior portions of the fuselage 16 and wing elements 22, 22, which are further developed in FIG. 6 where cockpit 12 is completed by a pair of downfold lines extending from a cockpit area to each of the generally front edge midpoints 50, 50 of the blank, these lines shown as 3, 3A in FIG. 2 generally forming bisecting angles between the line 2, 2A respectively and the forward edge 52 of the blank.

There are a pair of sets of at least two successive upfold lines 4, 5 and 6, 7 of the blank shown in FIG. 2 extending also from each of the generally midpoints 50, 50 of the forward edge 52, that is extending outwardly to the wing edges 54, 54.

A pair of wing forming downfold lines 8, 9 and which may be said to be essentially parallel to upfold lines 2, 2A described above, complete the fold of blank in structuring the fuselage and in which the outer or peripheral portions finally form the wing structures 22, 22, resulting in the structural and completed folded paper airplane of FIG. 1 including the steps or stages shown in FIGS. 6, 7, 8 and 9.

Shown on the blank and disposed on either or both sides thereof is seen provided an area 60, 60 for printing of promotional, trade name information or advertising material and the like in the form of printing characters pictorial representations or similar indicia.

Instructions printed for constructing the airplane may be also included on the blank forming the paper airplane or may be printed on a separate detachable tab (not shown) on the airplane and may include generally the form of instructions set forth as follows:

1. Fold paper on Line 1. First fold with printing in and then re-fold with printed lines out.
2. With paper folded, continue by folding on line 2. This will also fold line 2A.
3. Fold the paper the opposite way on Lines 2 and 2A to soften fold.
4. Bring Line 1 down between sides by folding lines 2 and 2A so that fold lines are on top. This will make a "V" shape as you look into the end of the paper.
5. Fold paper on Lines 3 and 3A (Lines will be on inside of paper - fold by seeing through paper. Fold flat and press fold to make it stay in place.
6. Fold "In" on Line 4—Press Fold.
7. Fold "In" on Line 5—Press Fold.
8. Fold "In" on Line 6—Press Fold.
9. Fold "In" on Line 7—Press Fold.
10. Fold "Out" on Line 8—Press Fold.
11. Fold "Out" on Line 9—Press Fold.
12. With Plane Folded, take scissors and cut on Lines 10 and 10A at one cut. The cut out parts marked X.
13. Then fold the rear part up to make a tail "Stabilizer."
14. Open the wings so that they are flat and the finished article looks like an airplane.

It is seen that there is thus taught and disclosed a new and unique folded paper airplane constructed from a blank which is formed in a series of several steps for folding and/or cutting of the blank so that there is formed a cockpit which has fast glide characteristics for flow of air by fold lines 3, 3A of FIG. 3 and in the alternative, which makes possible sufficient impedance to the flow of air by means of the fold lines 3, 3A after the manner of FIG. 3A, and which provides for a stabilizer and folded wing sections 22, 22 extending throughout the full length of the airplane 10. The design of the wings provides for adequately cupping of air for keeping the airplane afloat for longer periods of time, generally, while at the same time provides for more stabilizers for the airplane. Therefore, besides adequately and sufficiently looking like an airplane of modern design, it is seen that by the present construction and within the general concepts of aerodynamics, there is provided a flow of air evenly throughout the plane giving it increased stability over prior known airplane devices constructed from paper blanks and the like.

It is also possible that the control of the flight pattern is available by simply pinching the tail and rear wing structure for modifying, controlling and developing changes and improvements in the aerodynamic characteristics of the airplane. It is within the purview of the invention to provide for the folds 3, 3A to be folded off to one side of the aircraft as shown in FIGS. 1 and 3 while FIGS. 3A shows a modification such that the folds 3, 3A would be symmetrically folded about the center, the inward fold 1A between lines 3, 3A providing some significantly small aerodynamic impedance so that the nose of the aircraft is somewhat upwardly maintained.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A folded paper airplane comprising:

a blank of sheet material with a forward edge and a rear edge and having a downfold line extending centrally along an axis of the sheet material from said forward to said rear edge;

a pair of transverse cuts spaced from the rear edge of the blank for forming a tailpiece, said transverse cuts each having one end terminating at the downfold line and the other terminating at a respective upper edge forming a fuselage;

a pair of fuselage forming upfold lines each extending from adjacent a point of the transverse cut intersecting the downfold line to said forward edge at a respective point generally midway between the downfold line and a respective outer extremity of the blank;

a pair of cockpit forming downfold lines each extending from a respective said point generally midway of the forward edge to a cockpit area, and generally bisecting an angle formed by the associated fuselage upfold line and the forward edge;

a pair of sets of lines, each set comprising at least two successive upfold lines each extending also from a respective said point generally midway of the forward edge outwardly to an outer extremity of the blank and each set generally trisecting the angle between the associated fuselage forming upfold line and the forward edge of the blank; and a pair of wing forming downfold lines each extending from the respective leading edge of a resulting wing surface to the other termination of the respective transverse cut.

2. The invention of claim 1 wherein each of the transverse cuts have a general S-curve configuration defining said tailpiece.

3. The invention of claim 1 wherein the transverse cuts forming the rear contour of the fuselage are futher cut to round out the fuselage.

4. The invention of claim 1 wherein said blank of sheet material is generally of rectangular configuration.

5. The invention of claim 1 wherein said blank of sheet material includes printed indicia provided for promotional trade name and advertising uses.

6. A folded paper airplane comprising:

a blank of sheet material having a downfold line extending centrally along an axis of the sheet material from a forward edge to a rear edge;

a pair of transverse cuts spaced from the rear edge of the blank for forming a tailpiece and extending from the downfold line, said transverse cuts each having one end terminating at the downfold line and the other end at a respective edge forming a fuselage;

a pair of fuselage forming upfold lines each extending from adjacent the one end of respective said transverse cut to the forward edge at a point generally midway between the downfold line and a respective outer extremity of the blank;

a pair of cockpit forming fold lines each extending from a respective said point generally midway of the forward edge to a cockpit area, and generally bisecting an angle formed by the associated fuselage upfold lines and the forward edge so that the cockpit forming fold lines are folded upon themselves to one side of the airplane so forming the cockpit;

a pair of sets of lines, each set having at least two successive upfold lines extending also from a respective said point generally midway of the forward edge outwardly to a respective wing edge and each set generally trisecting an angle between the associated fuselage forming upfold line and a forward edge of the blank; and a pair of wing forming downfold lines each extending from the resepctive leading edge of a resulting wing surface to the other end termination of the respective transverse cut.

7. The invention of claim 6 wherein each said transverse cut has a generally S-curve configuration defining said tailpiece.

8. The invention of claim 6 wherein the transverse cuts forming the rear contour of the fuselage are further cut to round out the fuselage.

9. The invention of claim 6 wherein said blank of sheet material is generally of rectangular configuration.

10. The invention of claim 6 wherein said blank of sheet material includes printed indicia for promotional trade name and advertising uses.

* * * * *